US009739231B2

(12) United States Patent
Pegg et al.

(10) Patent No.: US 9,739,231 B2
(45) Date of Patent: Aug. 22, 2017

(54) ENGINE BLOCK

(71) Applicant: FORD GLOBAL TECHNOLOGIES, LLC, Dearborn, MI (US)

(72) Inventors: Ian Graham Pegg, Chelmsford (GB); Roland Paul Stark, Hitchin (GB)

(73) Assignee: Ford Global Technologies, LLC, Dearborn, MI (US)

( * ) Notice: Subject to any disclaimer, the term of this patent is extended or adjusted under 35 U.S.C. 154(b) by 85 days.

(21) Appl. No.: 14/701,029

(22) Filed: Apr. 30, 2015

(65) Prior Publication Data

US 2015/0322888 A1 Nov. 12, 2015

(30) Foreign Application Priority Data

May 6, 2014 (GB) ..... 1407924.8

(51) Int. Cl.

| | |
|---|---|
| ***F02F 7/00*** | (2006.01) |
| ***F02F 1/10*** | (2006.01) |
| *F01P 3/02* | (2006.01) |
| *F02F 1/20* | (2006.01) |

(52) U.S. Cl.

CPC ..... *F02F 1/10* (2013.01); *F02F 7/0002* (2013.01); *F02F 7/0021* (2013.01); *F01P 2003/021* (2013.01); *F02F 1/20* (2013.01)

(58) Field of Classification Search

CPC .. F01M 1/08; F02F 7/0007; F02F 2007/0063; F02F 2007/0041; F02F 1/00; F01P 3/02; F01P 2003/028; F01P 7/14; F01P 2003/024; F01P 2003/027

USPC ..... 123/193.1, 193.2, 193.6, 41.72, 41.82 R, 123/196 M

See application file for complete search history.

(56) References Cited

U.S. PATENT DOCUMENTS 4,610,228 A * 9/1986 Fink ..... B27B 17/00 123/195 C
4,702,204 A * 10/1987 Anno ..... F01M 5/00 123/196 AB
5,083,537 A * 1/1992 Onofrio ..... F02F 1/108 123/195 C (Continued)

FOREIGN PATENT DOCUMENTS

GB 2442736 A 4/2008
GB 2498782 A 7/2013

(Continued)

OTHER PUBLICATIONS

Great Britain Office Action for corresponding Application No. GB1407924.8, mailed Nov. 24, 2014, 6 pages.

*Primary Examiner* — Hai Huynh
*Assistant Examiner* — Long T Tran
(74) *Attorney, Agent, or Firm* — Brooks Kushman P.C.; Greg Brown

(57) ABSTRACT

An engine block has one or more bores configured for receiving one or more respective pistons; one or more coolant passages; and one or more lubricant passages. At least portions of the coolant passages and lubricant passages are disposed adjacent to and about the bores so as to cool the bores. The coolant passage portion extends over a first lengthwise portion of the bores and the lubricant passage portion extending over a second lengthwise portion of the bores. The first and second lengthwise portions are longitudinally spaced apart along the bores.

18 Claims, 8 Drawing Sheets

(56) References Cited

U.S. PATENT DOCUMENTS

| | | | | | |
|---|---|---|---|---|---|
| 5,253,615 | A * | 10/1993 | Heater | F02B 75/22 | 123/195 R |
| 5,474,040 | A * | 12/1995 | Murakami | F02F 7/0007 | 123/193.2 |
| 6,101,994 | A * | 8/2000 | Ichikawa | F01M 11/02 | 123/195 R |
| 8,096,270 | B2 * | 1/2012 | Yamada | B22D 19/00 | 123/193.2 |
| 8,746,187 | B2 * | 6/2014 | Nogawa | F01P 3/02 | 123/41.82 R |
| 2008/0035081 | A1 * | 2/2008 | Ruble | F02F 1/14 | 123/41.84 |
| 2008/0245320 | A1 * | 10/2008 | Ishikawa | F02F 1/10 | 123/41.74 |
| 2011/0030627 | A1 * | 2/2011 | Bing | B22D 19/0009 | 123/41.79 |
| 2011/0079187 | A1 * | 4/2011 | Steiner | F01L 1/022 | 123/41.82 R |
| 2012/0240880 | A1 | 9/2012 | Hineiti et al. | | |
| 2013/0146041 | A1 * | 6/2013 | Hijii | C25D 11/04 | 123/668 |

FOREIGN PATENT DOCUMENTS

| | | | |
|---|---|---|---|
| JP | 2006299932 | A | 11/2006 |
| JP | 2010144587 | A | 7/2010 |
| KR | 2020110009148 | A | 9/2011 |

* cited by examiner

ENGINE BLOCK

CROSS-REFERENCE TO RELATED APPLICATIONS

This application claims foreign priority benefits under 35 U.S.C. §119(a)-(d) to GB 1407924.8 filed May 6, 2014, which is hereby incorporated by reference in its entirety.

TECHNICAL FIELD

The present disclosure relates to an engine block, in particular, but not exclusively, an engine block with longitudinally spaced apart cooling zones around bores, the cooling zones formed from distinct coolant and lubricant passages.

BACKGROUND

In conventional internal combustion engines, the heat transfer rate to an engine block from a bore in which a piston reciprocates varies along the length of the bore. As a result the temperature of the engine block and degree of expansion may vary along the length of the bore. Such variation may affect the seal between a piston and the bore and may affect the performance of the engine.

Furthermore, during warm up of an internal combustion engine, the engine block structure acts as a large heat sink because the thermal inertia of the engine block structure is an order of magnitude greater than the coolant and oil. As a result, the engine block structure takes longer to warm up than the oil. By way of example, oil returning from a cylinder head of the engine has been heated and loses heat as it returns through the engine block to an oil sump. The resulting colder oil has a higher viscosity, which leads to higher friction losses. This in turn leads to worse fuel consumption.

Moreover, the drive for greater fuel economy and lower CO2 emissions for motor vehicle engines has resulted in smaller and lighter engines, turbochargers, direct injection and exhaust gas recirculation. However, these developments generate more heat. As a result of the additional heat generated by a modern turbocharged engine, a separate oil cooler is required to prevent the engine oil from degrading at the higher temperatures. However, the oil cooler and associated hardware add weight, complexity and cost to the vehicle. Furthermore, the oil cooler acts as an additional heat sink in the oil circuit. This additional thermal inertia slows down the warm up of oil that is delivered to the working parts of the engine.

SUMMARY

According to an aspect of the present disclosure there is provided an engine block comprising: one or more bores configured for receiving one or more respective pistons; one or more coolant passages; and one or more lubricant passages, wherein a portion of the or each coolant passage and a portion of the or each lubricant passage are disposed adjacent to and about a respective bore so as to cool the bore, the coolant passage portion extending over a first lengthwise portion of the bore and the lubricant passage portion extending over a second lengthwise portion of the bore, the first and second lengthwise portions being longitudinally spaced apart along the bore.

The coolant passages may be arranged so as to be in thermal communication with respective lubricant passages.

A further portion of the or each coolant passage may at least partially surround the respective lubricant passage portion. The further portion of the coolant passage may at least partially extend over the second lengthwise portion of the respective bore and radially outer of the respective lubricant passage portion.

The coolant and lubricant passage portions may be arranged such that the coolant passage portion may be at least partially directly above the lubricant passage portion. In other words, the coolant passage may be both above and behind the lubricant passage. (NB, "above" may mean further away from the crankshaft and "below" may be construed accordingly.)

The coolant and lubricant passage portions may be spaced substantially the same distance from the bore. The wall thickness between the bore and the coolant and lubricant passage portions may be substantially the same A wall between the coolant passage and lubricant passage may comprise one or more fins on one or both sides of the wall to increase the surface area.

The first lengthwise portion of the bore with the coolant passage portion may be positioned above the second lengthwise portion of the bore with the lubricant passage portion.

A third lengthwise portion of the bore may be positioned below the first and second lengthwise portions of the bore. The third lengthwise portion of the bore may not be directly cooled by the coolant passage portion and the lubricant passage portion. The engine block may be configured such that along the third lengthwise portion of the bore there may be an air gap between a cylinder wall and the remainder of the engine block or a crankcase. The air gap may extend about the bore. The air gap may be substantially tubular. The air gap may extend in a longitudinal direction relative to the bore.

The ratio of the lengths of the first and second lengthwise portions may be approximately 2:1 respectively. The ratio of the lengths of the first, second and third lengthwise portions may be approximately 50:25:25 respectively. Alternatively, a ratio of 1:1:1 may also be appropriate, e.g. the lengths of the first, second and/or third lengthwise portions may be substantially equal. These ratios may be dependent on the level of heat transfer to the lengthwise portions that is required and/or desired.

The coolant passage portion and lubricant passage portion may be arranged such that in use the bore has a substantially uniform temperature in a lengthwise direction. The coolant passage portion, lubricant passage portion and air gap may be arranged such that in use the bore has a substantially uniform temperature in a lengthwise direction An engine assembly may comprise the above-mentioned engine block. The engine assembly, such as an internal combustion engine, may further comprise a crankcase.

The engine block and/or crankcase are configured such that there may be an air gap between a cylinder wall and the crankcase. The engine assembly may further comprise a layer of insulation provided between the engine block and the crankcase.

The engine assembly may further comprise a cylinder head and one or more cylinder head bolts which may pass through the cylinder head. The cylinder head bolts may extend into the crankcase so as to clamp the engine block between the cylinder head and crankcase. The cylinder head bolts may be spaced apart and thermally isolated from the engine block. The engine assembly may comprise a further layer of insulation provided on an outer surface of the engine block.

The engine assembly may further comprise one or more thermally insulating ducts, e.g. tubes. The ducts may define one or more further lubricant passages. The ducts may be made from a thermally insulating plastic, such as nylon. One of the thermally insulating ducts may form a lubricant return passage returning from a cylinder head to a crankcase. The lubricant return passage may be spaced apart from the engine block.

The coolant passages and lubricant passages may be arranged such that in use there is sufficient heat transfer between the coolant and lubricant passages and that the engine assembly may not comprise a separate lubricant cooler.

A vehicle, such as an automobile, van or any other motor vehicle, may comprise the above-mentioned engine block or engine assembly.

According to a further aspect of the present disclosure, there is provided an engine assembly comprising a lubricant return passage returning from a cylinder head to a crankcase. The lubricant return passage may be spaced apart from an engine block of the engine assembly, e.g. such that there may be an air gap between the lubricant return passage and the engine block. The lubricant return passage may comprise a thermally insulating tube.

For a better understanding of the present disclosure, and to show more clearly how it may be carried into effect, reference will now be made, by way of example, to the accompanying drawings, in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
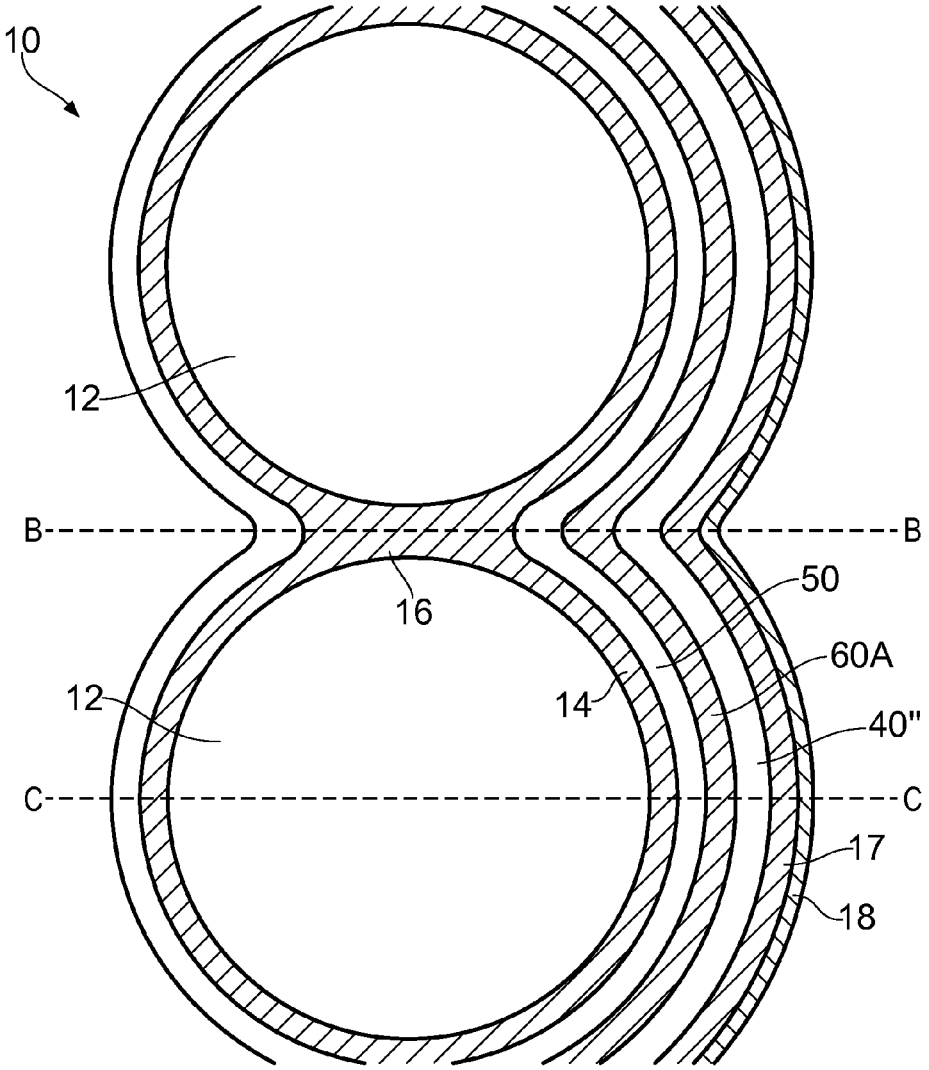
FIG. 1 shows a plan sectional view of an engine assembly with an engine block according to an example of the present disclosure where the section corresponds to section A-A shown in FIGS. 2 and 3.
Figure 2:
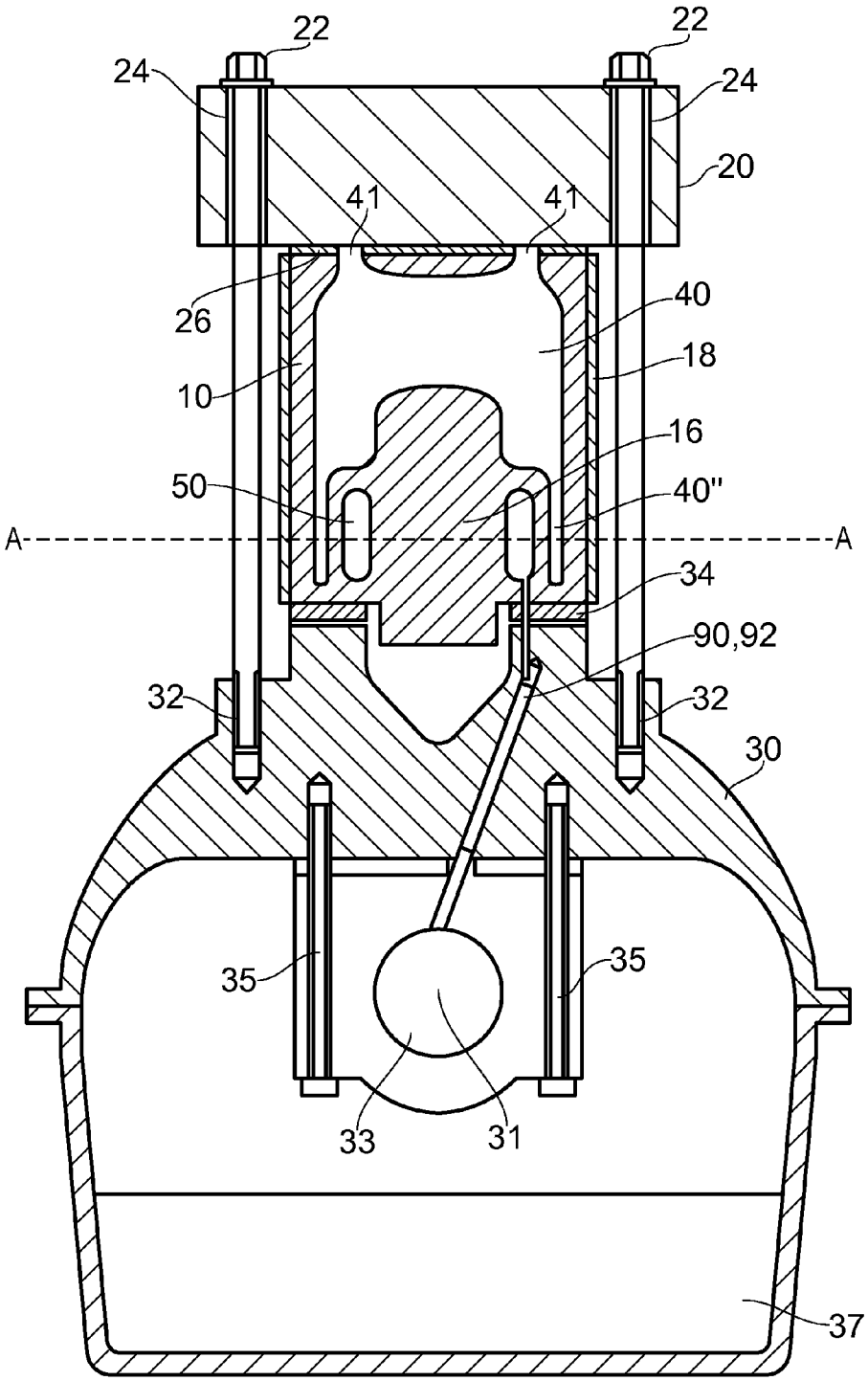
FIG. 2 shows a further side sectional view of the engine assembly with the engine block according to the example of the present disclosure where the section corresponds to section B-B shown in FIG. 1.
Figure 3:
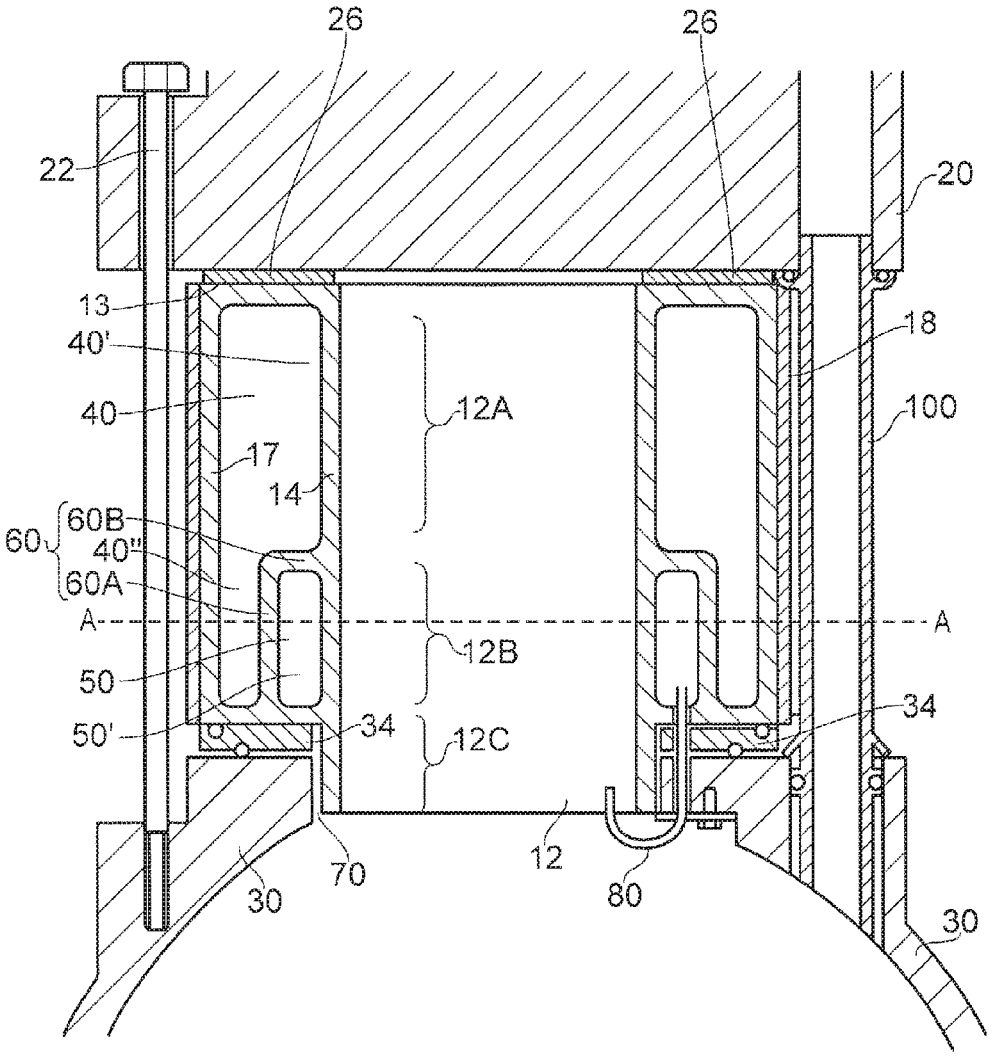
FIG. 3 shows a partial side sectional view of the engine assembly with the engine block according to the example of the present disclosure where the section corresponds to section C-C shown in FIG. 1.

With reference to FIGS. 1 to 3 the present disclosure relates to an engine block 10 comprising one or more bores 12 for receiving one or more reciprocating pistons (not shown), with the bores 12 intersecting a deck face 13 of the engine block 10. As such, the engine block 10 may form part of an engine, e.g. an internal combustion engine. It will be appreciated that each bore 12 may be cylindrical. Accordingly, the engine block 10 may also be referred to as a cylinder block.

As depicted in FIG. 2 the engine block 10 may be provided between a cylinder head 20 and a crankcase 30. Cylinder head bolts 22 may pass through apertures 24 in the cylinder head 20. The cylinder head bolts 22 may extend into corresponding apertures 32 in the crankcase 30. The crankcase apertures 32 may be threaded so as to threadably receive threaded ends of the cylinder head bolts 22. It will be appreciated that tightening the cylinder head bolts 22 ensures that the engine block 10 is clamped between the cylinder head 20 and the crankcase 30.

As shown in FIG. 2, the cylinder head bolts 22 may be spaced apart from the engine block 10. In other words the engine block 10 may be narrower than the spacing between opposite cylinder head bolts 22. As a result, the cylinder head bolts 22 may not be in contact with the engine block 10.

It will be appreciated that the crankcase 30 forms a housing for a crankshaft 31 of the engine. The crankshaft may be supported by one or more bearings 33, which may be secured to the crankcase 30 by bolts 35. The crankcase 30 may comprise a sump 37, which may contain a lubricant associated with the engine.

As depicted in FIG. 3, the engine block 10 comprises one or more coolant passages 40 and one or more lubricant passages 50. The coolant passages 40 may carry a coolant, such as water, and the lubricant passages 50 may carry a lubricant, such as oil. The coolant and lubricant passages 40, 50 are disposed about the bores 12 so as to cool the engine block 10 when in use. Accordingly a portion 40' of the coolant passages 40 and a portion 50' of the lubricant passages 50 are disposed adjacent to and about a respective bore 12. The coolant passage portion 40' extends over a first lengthwise portion 12A of the bore 12. The lubricant passage portion 50' extends over a second lengthwise portion 12B of the same bore 12. The first and second lengthwise portions 12A, 12B are longitudinally spaced apart along the bore length. In addition to this lengthwise arrangement, the coolant passages 40 and the lubricant passages 50 overlap, e.g. radially. In the particular example shown, a further portion 40" of the coolant passages 40 extends over the lubricant passages 50. In other words the further portion 40" extends below the first lengthwise portion 12A and into the second lengthwise portion 12B of bore 12. The further portion 40" of the coolant passages 40 is disposed at a radially outer position relative to the coolant passages 50. Although FIG. 3 shows the further portion 40" of the coolant passages 40 extending over the lubricant passages 50, in an alternative arrangement a further portion of the lubricant passages 50 may extend over the coolant passages 40, e.g. with the lubricant passages 50 overlapping the coolant passages 40. In a further alternative arrangement, there may be no overlap, e.g. in the vertical plane, between the coolant and lubricant passages 40, 50. For example, there may be sufficient heat transfer through a radially extended wall portion 60B between the coolant and lubricant passages 40, 50 such that an overlap may not be required.

The portion 40' of the coolant passages 40 may be radially spaced from the bore 12 at substantially the same distance as the lubricant passage 50. In other words, the inner wall 14 of the bore 12 may have substantially the same thickness along the first and second lengthwise portions 12A, 12B of the bore.

The coolant passages 40 for a particular bore 12 may be fluidically connected to the coolant passages of another bore, e.g. a neighbouring bore, of the engine. Likewise, the lubricant passages 50 for a particular bore 12 may be fluidically connected to the lubricant passages of another bore, e.g. a neighbouring bore, of the engine. Furthermore, the coolant passages 40 may be fluidically connected to a coolant system for the engine, for example through openings 41 at the top of the engine block 10. Likewise, the lubricant passages 50 may be fluidically connected to a lubricant system for the engine, for example the lubricant passages 50 may receive lubricant through one or more further passages (not shown) through the engine block.

Referring still to FIG. 3, a wall 60 may be provided between the coolant and lubricant passages 40, 50. The wall 60 may have a longitudinally extended portion 60A and the radially extended portion 60B, the longitudinal and radial directions being relative to the longitudinal axis of the bore 12. The radially extending portion 60B may protrude from an inner wall 14 of the bore 12. Thermal energy may be transferred between the coolant and lubricant passages 40, 50 through the wall 60. The extension of the further portion 40" of the coolant passages 40 over the lubricant passage 50 increases the area over which heat transfer may occur between the coolant and lubricant passages 40, 50. The heat transfer between the coolant passages 40 and lubricant passages 50 may be sufficient such that a separate lubricant cooler is not required for the engine.

Figure 4:
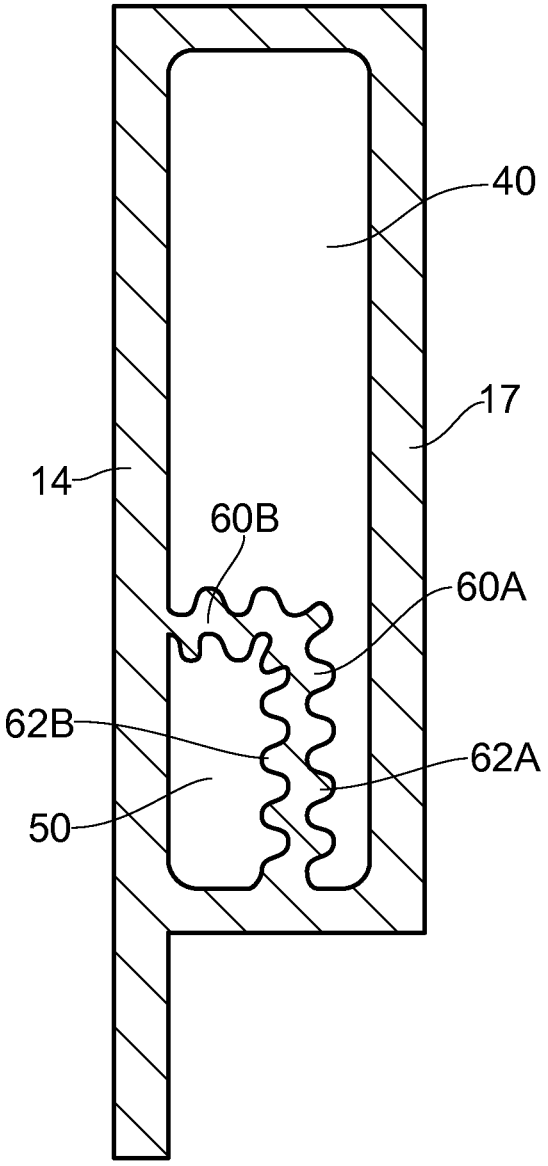
FIG. 4 shows a side sectional view of a wall between lubricant and coolant passages of the engine block according to a further example of the present disclosure where the section corresponds to section C-C shown in FIG. 1.

Although FIG. 3 shows the wall 60 being substantially smooth, with reference to FIG. 4 it is also envisaged that the wall 60 may be profiled, e.g. so as to increase its surface area. For example, the wall 60 may comprise one or more fins 62A which extend into the coolant passages 40 and/or one or more fins 62B which extend into the lubricant passages 50. Such profiling of the wall 60 may increase the surface area of the wall so as to improve the heat transfer rate between the coolant and lubricant passages 40, 50.

Referring still to FIG. 3, the first lengthwise portion 12A of the bore is located above the second lengthwise portion 12B of the bore 12. In this way, the cooler coolant may cool the hottest part of the bore 12 when the engine is running. The bore 12 is hotter towards the top when the engine is running since this part of the bore is exposed to hot gases for a longer period of time and it is closer to the combustion event. Spacing the coolant and lubricant passages 40, 50 along the longitudinal part in the manner described above allows more heat to be transferred towards the top of the bore 12 and thereby permits a more even temperature distribution along the length of the bore 12.

In addition to the first and second lengthwise portions 12A, 12B of the bore 12, a third lengthwise portion 12C may also be provided. The third lengthwise portion 12C may not be directly cooled by the coolant or lubricant passages 40, 50. By contrast, an air gap 70 may be provided behind the inner wall 14 of the bore 12 over the length of the third lengthwise portion 12C of the bore 12. The third lengthwise portion 12C may be beneath the first and second lengthwise portions 12A, 12B of the bore 12. Air within the air gap 70 may cool the bore 12 over the third lengthwise portion 12C. The heat transfer rate from the bore 12 to the air in the air gap 70 may be less than that from the bore to the coolant and lubricant passages 40, 50. However, the temperatures of the bore 12 are lower towards the bottom and therefore a lower heat transfer rate is acceptable. Moreover, the variation in the heat transfer rates over the first, second and third lengthwise portions 12A, 12B, 12C helps to provide an even temperature along the length of the bore 12. Such an even temperature of the bore 12 ensures that the bore expands uniformly along the length of the bore. To achieve an approximately uniform temperature distribution, it is anticipated that the first lengthwise portion 12A should be approximately twice as long as the second lengthwise portion 12B. In addition, the second and third lengthwise portions 12B, 12C may be approximately the same length. In other words the ratio of the lengths of the first, second and third lengthwise portions 12A, 12B, 12C may be approximately 50:25:25. These ratios are dependent on the required and/or desired level of heat transfer to the lengthwise portions. For example, a ratio of 1:1:1 may also be appropriate. The selection of the exact split will depend on achieving a balance between the desired heat transfer to the lubricant and coolant and a uniform liner temperature.

Figure 5:
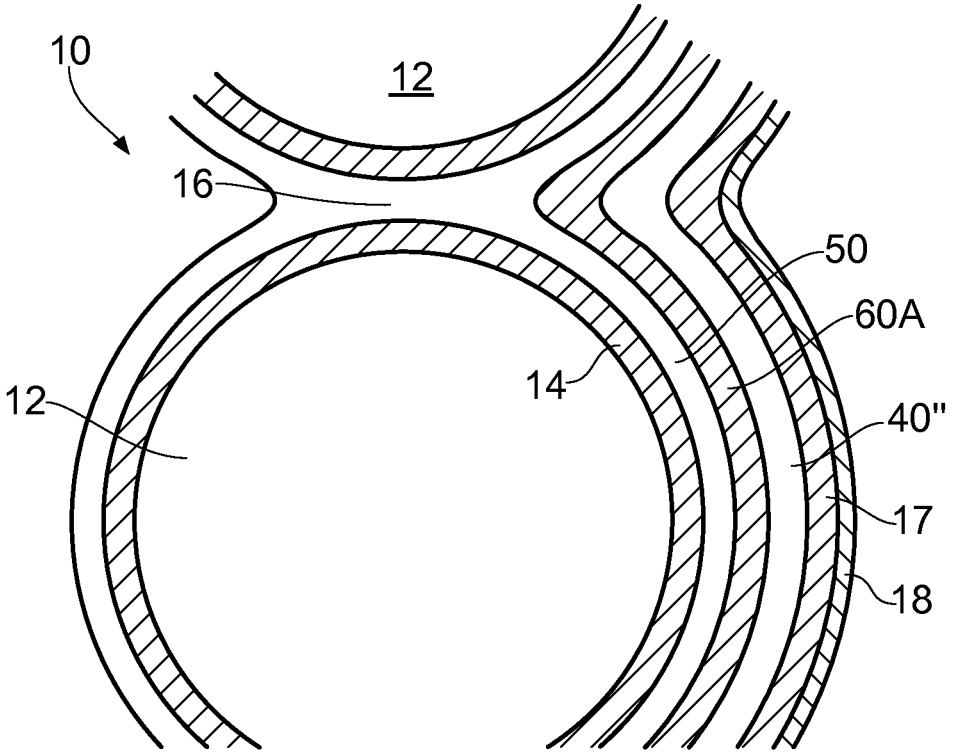
FIG. 5 shows a plan sectional view of an engine assembly with an engine block according to an alternative example of the present disclosure where the section corresponds to section A-A shown in FIG. 2.

Returning now to FIG. 1, which shows a plan sectional view of the engine block 10 corresponding to section AA shown in FIGS. 2 and 3, the extent to which the cooling and lubricant passages 40, 50 surround the bore 12 is shown. As is depicted, the lubricant passage 50 does not necessarily extend around the entire circumference of the bore 12. For example, the lubricant passage 50 may not extend into an inter bore region 16, which is between neighbouring bores 12. Likewise, the further portion 40" of the coolant passages 40, which surrounds the lubricant passages 50, may not extend into the inter bore region 16. However, in an alternative arrangement depicted in FIG. 5, the lubricant passage 40 may extend into the inter bore region 60 such that the lubricant passages 50 extend around the entire circumference of the bore 12. In the alternative arrangement shown in FIG. 5, it will be appreciated that the coolant passages 40 do not extend into the inter bore region 16 which is occupied by the lubricant passages 50. In either case, the lubricant passages 50 are in fluidic communication with lubricant passages of a neighbouring bore. Similarly, the coolant passages 40 of a particular bore may be in fluidic communication with coolant passages of a neighbouring bore.

Returning to FIG. 3 an insulating layer 26 may be provided between a deck face of the cylinder head 20 and a deck face 13 of the engine block 10. The insulating layer 26 may thermally insulate the cylinder head 20 from the engine block 10. In a similar fashion the crankcase 30 may be thermally insulated from the engine block 10 by virtue of a further insulating layer 34 disposed between the engine block 10 and crankcase 30. Thermally insulating the engine block 10 from the cylinder head 20 and/or crankcase 30 may allow the lubricant to warm up more quickly since the lubricant in the engine block 10 is not in thermal communication with the thermal mass of the cylinder head 20 and/or crankcase 30.

Further insulation may be provided about the engine block 10. The further insulation may be in the form of a layer of insulation 18 which may be provided on an outer wall 17 of the engine block 10. The further layer of insulation 18 may further insulate the lubricant in the engine block and may assist in maintaining lubricant temperatures.

Figure 6:
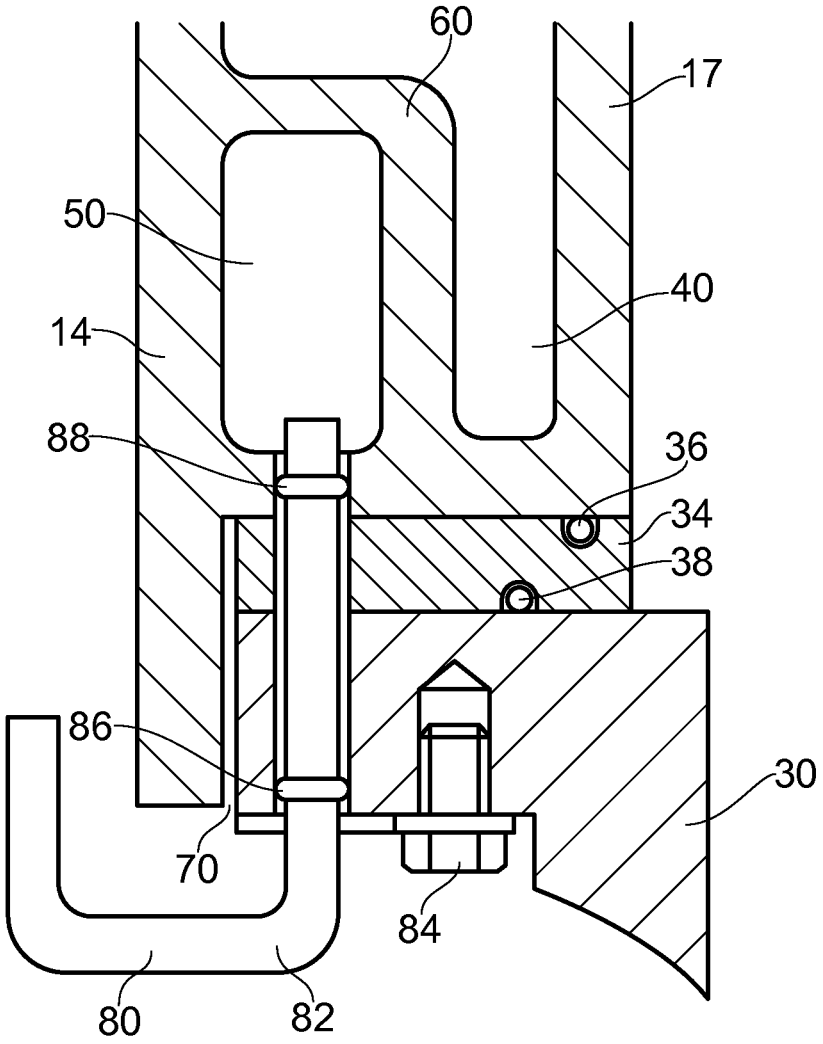
FIG. 6 shows a side sectional view of the interface between the engine block and a crankcase according to the example of the present disclosure where the section corresponds to section C-C shown in FIG. 1.

Referring now to FIG. 6, further detail of the interface between the engine block 10 and the crankcase 30 will be described. As mentioned above, the further insulating layer 34 may be provided between the engine block 10 and the crankcase 30. One or more seals 36, 38 may be provided between the engine block 10 and insulating layer 34 and/or the crankcase 30 and insulating layer 34. The seals 36, 38 may be provided in recesses in the further insulating layer 34. Furthermore, the inner bore wall 14 of the engine block 10 may extend into an opening defined by the crankcase 30 and the crankcase 30 may be radially set back from the inner bore wall 14, the radial direction being relative to the longitudinal axis of the bore 12. The further insulating layer 34 may also be radially set back from the bore wall 14. Spacing the crankcase 13 and inner bore wall 14 apart in this way creates the air gap 70. The air gap 70, together with the insulating layer 34, thermally insulates the engine block 10 from the crankcase 30.

Referring still to FIG. 6, the engine of the present disclosure may also comprise a piston cooling jet 80. The piston cooling jet 80 may spray lubricant toward the piston of the engine. Lubricant in the lubricant passages 50 may pass through a duct member 82, which may extend through the crankcase 30, the insulating layer 34 and/or the engine block 10. The duct member 82 may be substantially tubular. The duct member 82 may be shaped so as to direct lubricant towards the piston which reciprocates in the bore 12. The duct member 82 may be secured to the crank case 30 by virtue of a fastening 84, which may be in the form of a bolt. Seals 86, 88 may be provided between the duct member 82 and the crankcase 30 and the duct member 82 and the engine block 10.

Figure 7:
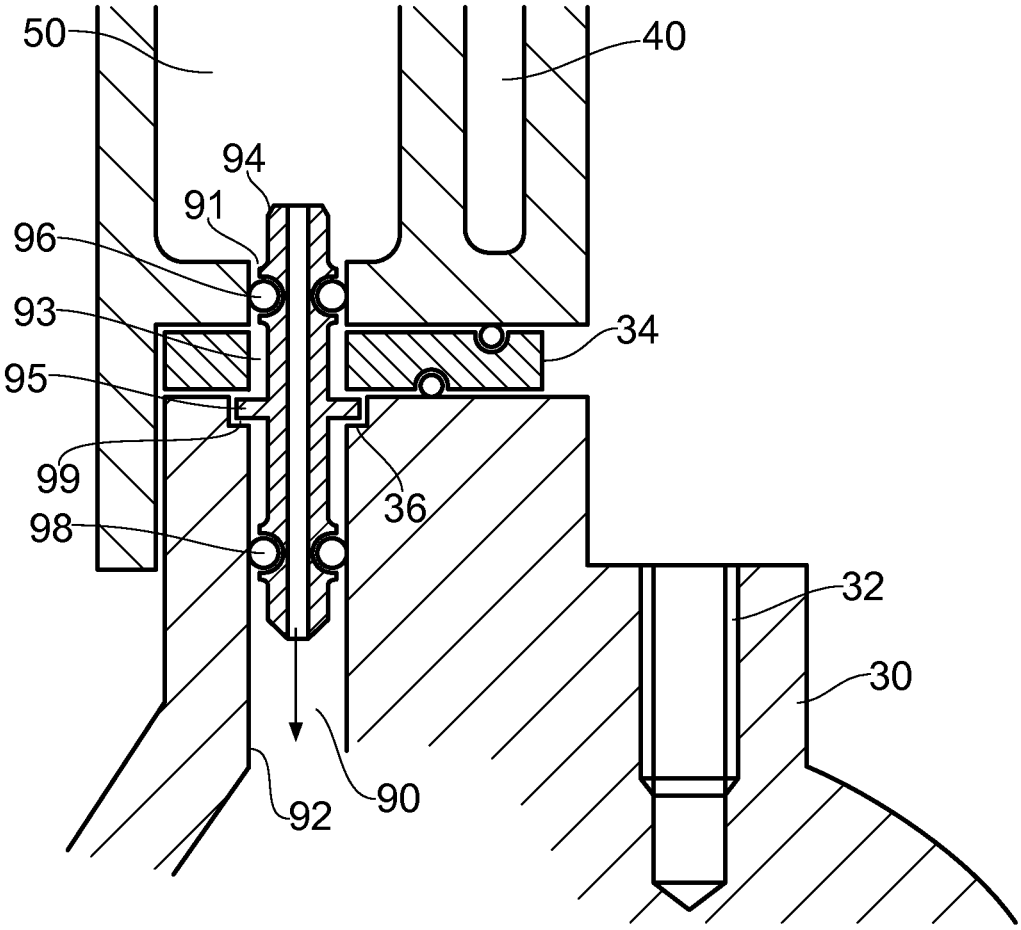
FIG. 7 shows a side sectional view of the interface between the engine block and the crankcase according to the example of the present disclosure where the section corresponds to section B-B shown in FIG. 1.

Referring now to FIG. 7, a further lubricant passage 90 will be described. (FIG. 7 also depicts the interface between the engine block 10 and crankcase 30 albeit in a different plane to that depicted in FIG. 6.) The further lubricant passage 90 may provide lubricant to crankshaft bearings 33. The further lubricant passage 90 may provide a flow path for lubricant from the lubricant passages 50 to the crankshaft bearings 33. As depicted in FIGS. 2 and 7, the further lubricant passage 90 may comprise a crankcase passage 92 to direct lubricant from the interface between the engine block 10 and the crankcase 30 to the crankshaft bearings 33. Corresponding openings 91, 93 may be provided in the engine block 10 and/or the layer of insulation 34 respectively to permit lubricant from the lubricant passages 50 to pass into crankcase passage 92.

As shown in FIG. 7, a feed tube 94 may be provided through the openings 91, 93 in the engine block 10 and insulating layer 34. The feed tube 94 may be made from a thermally insulating material, such as a plastic, e.g. nylon. The thermally insulating feed tube 94 may further ensure that the engine block 10 is thermally insulated from the crankcase 30. The feed tube 94 may be provided with seals 96, 98 which may seal the tube against the engine block 10 and the crankcase 30 respectively. The feed tube 94 may comprise an abutment surface 99 which is configured to abut a corresponding abutment surface 36 provided in the crankcase 30. The abutment surfaces 99, 36 may help locate the tube 94 and may ensure the tube 94 does not fall into the crankcase passage 92. The abutment surface 99 of the feed tube 94 may be provided on a radially extending protrusion 95 of the feed tube. The protrusion 95 may be further held in place by the insulating layer 34 which, when installed, may be provided above the protrusion 95. The feed tube 94 may have a passage extending therethrough so that lubricant can pass from the lubricant passages 50 to the crankcase passage 92 and subsequently to the crankshaft bearings 33.

Figure 8:
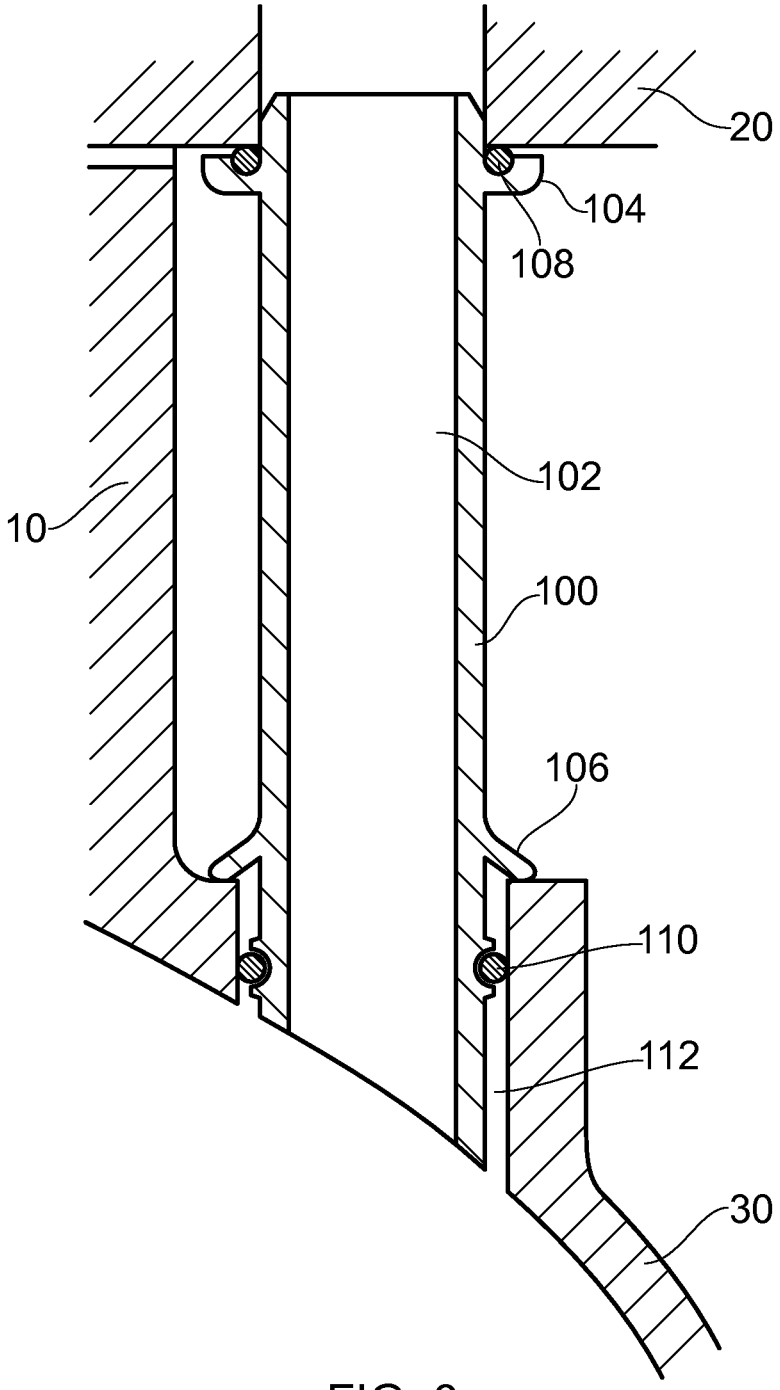
FIG. 8 shows a side sectional view of a thermally insulating tube of the engine assembly according to the example of the present disclosure where the section corresponds to section C-C shown in FIG. 1.

Referring now to FIG. 8, a lubricant return duct 100 will be described. The lubricant return duct 100 is positioned between the cylinder head 20 and the crankcase 30 and is arranged to permit the flow of lubricant returning from the cylinder head to the crankcase. The lubricant return duct 100 may be tubular. The lubricant return duct 100 may comprise a central passage 102 which extends through the return duct 100 and through which the lubricant may flow.

The lubricant return duct 100 may be spaced apart from the engine block 10. A longitudinal axis of the lubricant return duct 100 may be substantially parallel to a longitudinal axis of the bore 12. Accordingly, the lubricant return duct 100 may be spaced apart from the engine block in a radial direction relative to the bore along the longitudinal axis. One or more lubricant return ducts 100 may be provided, for example each bore 12 may have a lubricant return duct 100 associated with it. The lubricant return duct 100 may be provided in substantially the same plane as the bore 12 as depicted in FIG. 3. Furthermore, when viewed from above, the lubricant return duct 100 may be spaced apart from the cylinder head bolts 22, as is apparent from FIGS. 2 and 3.

The lubricant return duct 100 may extend into an opening in the cylinder head 20. Likewise, the lubricant return duct 100 may extend into an opening in the crankcase 30. The lubricant return duct 100 may comprise locating protrusions 104, 106, which may locate the lubricant return duct 100 relative to the cylinder head 20 and the crankcase 30 respectively. The locating protrusions 104, 106 may be provided at or towards opposite ends of the lubricant return duct 100. The locating protrusion 104 may comprise a recess for accommodating a seal 108 which may be disposed about the perimeter of the lubricant return duct 100. The seal 108 may abut the cylinder head 20 so as to provide a seal between the cylinder head 20 and the lubricant return duct 100. A further seal 110 may be disposed about the lubricant return duct 100 and may seal the lubricant return duct 100 against the crankcase 30. The lubricant return duct may be made from a thermally insulating material, such as a plastic, e.g. nylon. The thermally insulating lubricant return duct 100 may help to thermally isolate the engine block 10 from the cylinder head 20 and/or the crankcase 30. This may be achieved by the choice of the material for the thermally insulating return duct 100 and/or the spacing apart of the return duct 100 from the engine block 10. The thermal insulation is further aided by an air gap 112 which is provided between the lubricant return duct 100 and the opening in the crankcase 30. The air gap 112 is disposed about the perimeter of the lubricant return duct 100. In this way the lubricant return duct 100 is in contact with the crankcase only at the locating protrusion 106.

It will be appreciated by those skilled in the art that although the invention has been described by way of example with reference to one or more examples, it is not limited to the disclosed examples and that alternative examples could be constructed without departing from the scope of the invention as defined by the appended claims.

While exemplary embodiments are described above, it is not intended that these embodiments describe all possible forms of the invention. Rather, the words used in the specification are words of description rather than limitation, and it is understood that various changes may be made without departing from the spirit and scope of the invention.

Additionally, the features of various implementing embodiments may be combined to form further embodiments of the invention.

What is claimed is:

1. An engine block comprising: one or more bores intersecting a deck face adapted to cooperate with a cylinder head and configured for receiving one or more respective pistons; a coolant passage; and a lubricant passage, wherein a portion of the coolant passage and a portion of the lubricant passage are disposed adjacent to and about a respective bore so as to cool the bore, the coolant passage portion extending over a first lengthwise portion of the bore and the lubricant passage portion extending over a second lengthwise portion of the bore, the first and second lengthwise portions being longitudinally spaced apart along the bore;

wherein the portion of the coolant passage is positioned between the lubricant passage and the deck face to be above the lubricant passage and such that the lubricant passage is spaced apart from the deck face, and such that the first lengthwise portion of the bore extends between the deck face and the second lengthwise portion of the bore; and wherein the coolant passage has a further portion positioned radially outer of the lubricant passage and exterior thereto such that the further portion of the coolant passage at least partially extends over the second lengthwise portion of the respective bore and such that the lubricant passage is positioned between the bore and the further portion of the coolant passage.

2. The engine block of claim 1 further comprising a wall separating the coolant passage from the lubricant passage, wherein the coolant passage is in thermal communication with the lubricant passage via the wall.

3. The engine block of claim 2, wherein the wall between the coolant passage and the lubricant passage comprises one or more fins on one or both sides of the wall to increase surface area.

4. The engine block of claim 1, wherein a third lengthwise portion of the bore is not directly cooled by the coolant passage portion and lubricant passage portion.

5. The engine block of claim 4, wherein the second lengthwise portion of the bore is positioned between the first and third lengthwise portions of the bore.

6. The engine block of claim 5, wherein the engine block is configured such that along the third lengthwise portion of the bore there is an air gap between a cylinder wall and a remainder of the engine block or a crankcase.

7. The engine block of claim 5, wherein a ratio of the lengths of the first, second and third lengthwise portions is approximately 50:25:25 respectively.

8. An engine comprising:

a block defining first and second adjacent bores intersecting a deck face, with a coolant passage and a lubricant passage each extending along an outer perimeter of the first and second bores, the coolant passage having a portion radially outboard and overlapping with the lubricant passage to be exterior thereto, and having another portion positioned between the lubricant passage and the deck face to be above the lubricant passage.

9. The engine of claim 8 further comprising a crankcase;

wherein at least one of the engine block and the crankcase are configured such that there is an air gap between a cylinder wall and the crankcase.

10. The engine of claim 8 further comprising a crankcase; and a layer of insulation provided between the engine block and the crankcase.

11. The engine of claim 10 further comprising a further layer of insulation provided on an outer surface of the block.

12. The engine of claim 8 further comprising a crankcase; and a cylinder head and cylinder head bolts which pass through the cylinder head and extend into the crankcase so as to clamp the block between the cylinder head and crankcase, wherein the cylinder head bolts are positioned outside of the block such that the cylinder head bolts are spaced apart and thermally isolated from the block.

13. The engine of claim 8 further comprising a thermally insulating duct, which defines a further lubricant return passage from a cylinder head to a crankcase, and wherein the lubricant return passage is spaced apart from and positioned outside of the block.

14. The engine of claim 8 wherein the engine is independent of a separate lubricant cooler, and wherein the block comprises a wall separating the coolant passage and lubricant passage, the wall configured to provide heat transfer between the coolant and lubricant passages to cool lubricant in the lubricant passage.

15. The engine of claim 8 wherein the block further comprises a wall separating the coolant passage and the lubricant passage, the wall having a first portion extending radially from the first and second bores and a second portion extending longitudinally from the first portion.

16. The engine of claim 15 wherein thermal energy is transferred between the coolant passage and the lubricant passage across the wall.

17. The engine of claim 8 wherein the portion of the coolant passage is positioned directly adjacent to the outer perimeter of a first longitudinal portion of the first and second bores and the lubricant passage is positioned directly adjacent to the outer perimeter of a second longitudinal portion of the first and second bores, wherein the first and second longitudinal portions are longitudinally spaced apart; and wherein the another portion of the coolant passage is positioned directly adjacent to an outer perimeter of the lubricant passage along the second longitudinal portion of the first and second bores.

18. An engine block comprising: one or more bores intersecting a deck face adapted to cooperate with a cylinder head and configured for receiving one or more respective pistons; a coolant passage; and a lubricant passage, wherein a portion of the coolant passage and a portion of the lubricant passage are disposed adjacent to and about a respective bore so as to cool the bore, the coolant passage portion extending over a first lengthwise portion of the bore and the lubricant passage portion extending over a second lengthwise portion of the bore, the first and second lengthwise portions being longitudinally spaced apart along the bore;

wherein the portion of the coolant passage is positioned between the lubricant passage and the deck face such that the lubricant passage is spaced apart from the deck face, and such that the first lengthwise portion of the bore extends between the deck face and the second lengthwise portion of the bore;

wherein the second lengthwise portion of the bore is positioned between the first lengthwise portion and a third lengthwise portion of the bore; and wherein the engine block is configured such that along the third lengthwise portion of the bore there is an air gap between a cylinder wall and a remainder of the engine block such that the third lengthwise portion of the bore is not directly cooled by the coolant passage portion and lubricant passage portion.

* * * * *